US005483859A

United States Patent [19]

Singer

[11] Patent Number: 5,483,859

[45] Date of Patent: Jan. 16, 1996

[54] COMBINATION STRUMMING PICK AND PERCUSSION DEVICE

[76] Inventor: Vanessa L. Singer, 7210 Jordan Ave., No. B83, Canoga Park, Calif. 91304

[21] Appl. No.: 355,046

[22] Filed: Dec. 13, 1994

[51] Int. Cl.[6] ..... G10D 3/16; G10D 13/08; A63H 5/00

[52] U.S. Cl. ..... 84/322; 84/402; 446/419; D17/20

[58] Field of Search ..... 84/322, 402, 404; D17/20; 446/419

[56] References Cited

U.S. PATENT DOCUMENTS 4,794,839 1/1989 Adler ..... 84/322

*Primary Examiner*—Cassandra C. Spyrou
*Attorney, Agent, or Firm*—Albert O. Cota

[57] ABSTRACT

A combination strumming pick and percussion device (10) that consists of a hollow enclosed container (12) into which is inserted a multiplicity of free-flowing particles (14) that may be selected from sand (14A), wooden beads (14B), plastic beads (14C), steel pellets (14D) and lead pellets (14E). On at least one side of the container (12) is embedded a selectable guitar pick (16). The device (10) is designed to be easily and comfortably held in the hand while the pick is oscillated when a stringed instrument such as a guitar is strummed. The device (10) produces a rhythmic sound emitted by the strumming of the guitar strings and a percussion sound produced by the particles (14) impinging on the internal walls of the container. Either sound may be produced individually or the sounds may be combined. The container (12) can be made in several shapes including cylindrical, elliptical, spherical, cubic and conic. Likewise, the pick (16) can be selected with a shape that is conducive to the type of music that is being played by a musician.

21 Claims, 4 Drawing Sheets

COMBINATION STRUMMING PICK AND PERCUSSION DEVICE

TECHNICAL FIELD

The invention pertains to the combined general fields of guitar picking/strumming devices and percussion instruments and more particularly to a hand-held, combination strumming pick and percussion device that allows a guitar or the like to be strummed in compliment with a percussive sound.

BACKGROUND ART

Stringed instruments such as guitars, banjos, and autoharps have long been used as a source of entertainment. These stringed instruments are most often played by strumming the strings with a small, substantially pointed flat device referred to as a pick. The grasping or holding of a pick is sometimes difficult because of its relatively small size. The holding of these small picks is especially difficult for persons who lack the small-motor coordination skill that is required to grasp, and manipulate or orient a pick for use with the stringed instruments. These persons also encounter difficulties in establishing the consistent rhythmic, strumming motions that are necessary to produce a pleasant musical sound.

The applicant's device utilizes a pick that projects from a hollow enclosed container that is ergonomically designed to allow it to be easily and comfortably held in one's hand. Thus, the problems associated with the holding of a small pick are eliminated or at least minimized. In the the above discussion, a pick is used to produce a sound that emanates from the strumming of the strings. In the applicant's combination strumming pick and percussion device, a strumming sound as well as a percussive sound, can be produced. The percussive sound is produced by a multiplicity of particles, consisting of beads and/or pellets that are inserted into the container. When the container is oscillated, the particles impinge on the internal wall of the container to produce the percussive sound. Thus, a musician is able to selectively produce a strumming sound and/or a percussive sound. By practicing, a musician can learn to manipulate the pick to produce wide tonal variations and various combinations of strumming and percussive sounds.

A search of the prior art did not disclose any patents that read on the claims of the instant invention which cover a device that selectively produces both a strumming and a percussive sound. However, the following U.S. patents are considered related and indicative of the state-of-the-art:

| U.S. PAT. NO. | INVENTOR | ISSUED | |
|---|---|---|---|
| 4,320,689 | Pogoda | 23 March | 1982 |
| 4,306,485 | Rudkin | 23 December | 1981 |
| 4,179,973 | White | 25 December | 1979 |

The U.S. Pat. No. 4,320,689 Pogoda patent discloses a combined pick and stringed instrument tuning device. The device includes a relatively flat, rectangularly shaped housing having a pick attached thereto and is small enough to be held in one's hand. A momentary ON push-button switch, which is mounted on top of the housing, controls an electronic tuning circuit by selecting one of several predetermined frequencies from a frequency generator. The tuning circuit is mounted in the housing so that the tuning device is totally self-contained. Alternatively, the tuning circuit is remotely located and is controlled by a cable connected to the housing or by radio signals.

The U.S. Pat. No. 4,306,485 Rudkin patent discloses a hand-held percussion instrument. The instrument consists of a hollow, elongate cylindrical member having a plurality of sound producing beads disposed therein. The beads are in free-flowing disposition so that oscillation or other movement of the member causes the beads to impinge upon the internal walls of the cylindrical member, thereby producing the sound. A pair of symmetrically positioned convex walls are positioned mid-length in the interior of the instrument to define a convex-shaped volume therebetween. A plurality of circumferentially spaced ports open the volume defined by the walls to the atmosphere so that the sounds generated by the impinging of the beads against the convex walls flows to the listener through the ports.

The U.S. Pat. No. 4,179,973 White patent discloses a musical instrument consisting of a generally tubular hollow casing having a reduced geometry at one end. The casing is filled with popcorn kernels or other sound generating kernels, pellets or the like When the casing is shook by a user, the casing generates musical or other tones.

For background purposes and as indicative of the art to which the invention relates, reference may be made to the following remaining patents found in the search:

| U.S. PAT. NO. | INVENTOR | ISSUED | |
|---|---|---|---|
| 5,261,307 | Domanski | 16 November | 1993 |
| 4,794,839 | Adler | 3 January | 1989 |

DISCLOSURE OF THE INVENTION

The combination strumming pick and percussion device pick in its most basic design configuration consists of:

a) a hollow enclosed container, b) a multiplicity of particles located within the container, and c) a guitar pick that is attached to one side of the container.

The container which is disclosed in several designs, is ergonomically shaped to allow it to be easily and comfortably held in one's hand. When the container is oscillated, the particles impinge on the internal walls of the container to produce a percussive sound. Likewise, when the pick portion of the invention is used to strike and vibrate the strings of a guitar, a strumming sound is heard. The sounds made are controlled by the musician and can be produced either individually, in sequence, or as a combination rhythmic sound that includes both the strummed and percussive sounds.

The hollow enclosed container disclosed can be made in several shapes which include cylindrical, elliptical, spherical, cubed and conic shapes. The container is constructed of a rigid material such as wood, metal, rawhide or preferably a plastic material. In all the designs, the container is partially filled with particles that can consist of S and, plastic beads, wood beads, steel pellets and/or lead pellets.

The cylindrically shaped container includes at least one removable cap and in a sub-embodiment, a baffle divides the cylinder into two cavities. Into each cavity is inserted particles preferably having different sizes and densities to allow a composite percussive sound to be produced.

The elliptically shaped container may be made with one of the longitudinal sides having a substantially flat section which facilitates the grasping of the container. Also, one end of the elliptical container may be truncated to allow the container to be placed upright upon a flat surface. The flat and truncated section may also be included with the spherically shaped container.

The guitar pick used with the inventive container has a longer length than conventional picks to allow the lower or inward section of the pick to be inserted into a container. Any type and shape of pick can be used and in some cases a pick is used that has the picking section located normal to the longitudinal axis of the container. With this pick arrangement, a mope natural position is achieved when picking a guitar other stringed instrument. The pick is attached to the container by an attachment means that preferable consists of a container having a slot or cavity that includes a pair of male or female detents that interface with respective female and male detents located on the pick.

To further add utility to the inventive device, an audio amplifying circuit is disclosed. This circuit includes a transducer that is attached to the surface of the container. The transducer converts the mechanical energy produced by the oscillating container to an electrical signal. This signal is applied to a signal conditioner and amplifier from where the amplified signal is applied to an audio speaker that reproduces the audio signal.

In view of the above disclosure, it is the primary object of the invention to produce a device that is utilized by a musician to produce a strumming sound when a guitar is picked and to produced a complimentary percussive sound, either separately or in combination with the strumming sound, when the device is oscillated.

In addition to the primary object of the invention, it is also an object of the invention to produce a combination strumming pick and percussion device that:

- can be designed to produce various types and levels of percussive sounds by selecting the size, type and quantity of the sound-producing particles,
- produces musically-pleasing sounds in response to the movement imparted by a musician on the musical percussion pick,
- produces sounds without limiting the creative expression of a musician,
- can be easily and comfortably held in one's hand,
- prevents or at least minimizes the problem of losing and/or misplacing conventional picks,
- allows physically challenged persons that have difficulty grasping or holding a conventional pick to hold the inventive musical percussion pick,
- requires no additional training to use the device,
- produces a sound that is useful in encouraging people to dance by creating and establishing a percussive rhythm or beat that is conducive for dancing,
- is durable and reliable, and
- is cost effective from both a manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment that is disclosed in several design configurations. The combination strumming pick and percussion device 10 is designed to provide a musician with a device that allows rhythmic musical sounds to be emitted that include the strumming of a guitar and a complimentary percussion sound. The sounds may be individually produced or a composite sound that includes both the strumming and the percussion sounds may be produced. The preferred embodiment as shown in FIGS. 1–16 is comprised of three major elements: a hollow enclosed container a multiplicity of particles 14 and a pick 16. The preferred embodiment also can be used with an audio amplifying circuit that amplifies the combination rhythmic sound.

Figure 1:
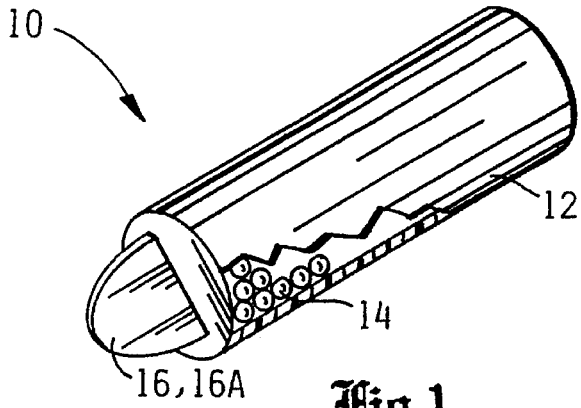
FIG. 1 is a partial cutaway and perspective view of a combination strumming pick and percussion device that employs a hollow enclosed container having particles inside and a pick that extends from one end of the container.

The basic design of the combination strumming pick and percussion device 10 is illustrated in FIG. 1 which shows the hollow enclosed container 12 partially filled with a multiplicity of particles 14 and a pick 16 extending from one end of the container 12.

Figure 2:
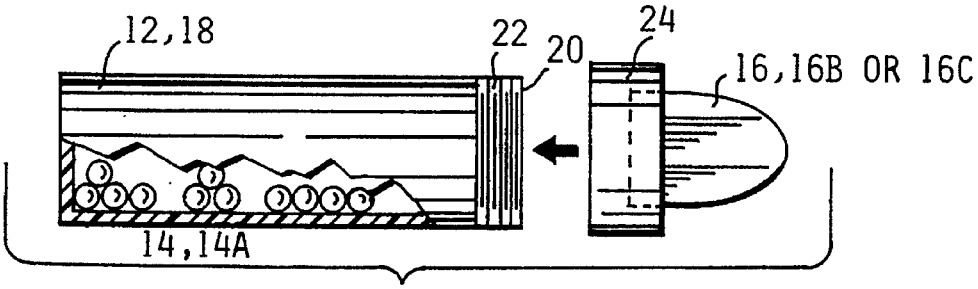
FIG. 2 is a partial cutaway and elevational side view of a container having an elongated cylindrical shape that includes an end cap that incorporates a pick.

Several design configurations are disclosed for the container 12 which can be made of wood, metal, rawhide or plastic, with a plastic preferred. In FIG. 2 is shown a hollow enclosed container 12 having an elongated cylindrical shape 18. In this first design, the elongated cylinder 18 has an open end 20 that includes a threaded section 22. Into the cylinder is inserted the multiplicity of particles 14 after which a threaded cap 24 that includes an embedded pick 16 is threaded into the cylinder 18 to complete the first design of the device 10. To permanently secure the cap to the container, a small amount of cement can be applied to the cap before it is threaded. Also, a threaded cap can be utilized in any of the other designs that are described infra.

Figure 3:
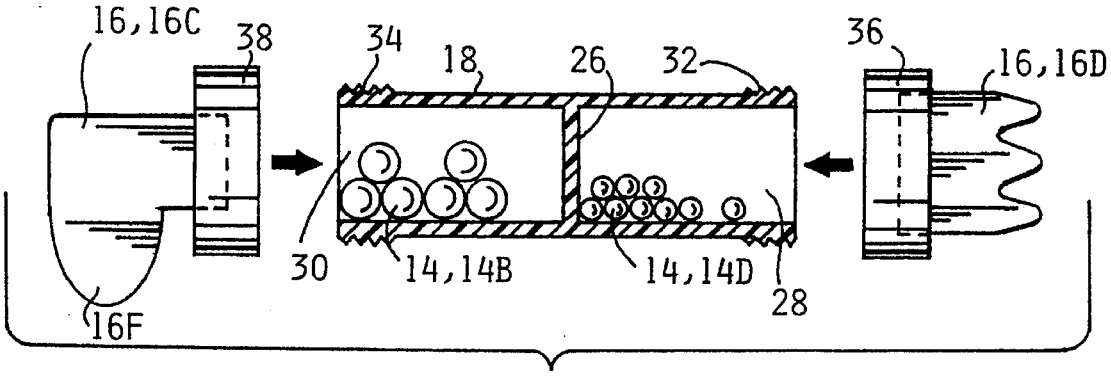
FIG. 3 is a partial sectional view of an elongated cylindrically shaped container having a baffle at midpoint that divides the container into two capped cavities, where into each cavity is inserted different sizes and densities of particles. This figure also shows a pick having a picking section that is located normal to the longitudinal axis of the container.

In FIG. 3 is illustrated a modified design for a cylindrical container 12 having an elongated cylindrical shape 18. In this design, an internal dividing baffle 26 is located substantially at the midpoint of the elongated cylinder 18. The baffle 26 divides the cylinder into a first cavity 28 and a second cavity 30. Into these cavities is inserted a multiplicity of particle 14 are also shown in FIG. 2. Preferably, the particles inserted into the first cavity 28 differ in size and density from the particles 14 inserted into the second cavity 30. This difference allows a combination rhythmic sound to be produced. The cylinder 18 includes a first threaded end 32 and a second threaded end 34. Into these ends is threaded respectfully a first threaded cap 36 and a second threaded cap 38 where into each cap is located an embedded pick 16.

Figure 5:
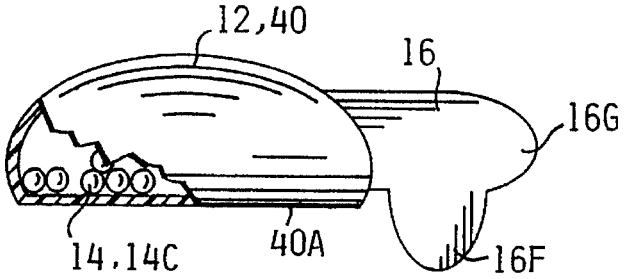
FIG. 5 is a partial cutaway and elevational side view of a container having a modified elliptical shape that has a substantially flat bottom section and that includes a pick that has two picking sections with one picking section located normal to the longitudinal axis of the container.
Figure 6:
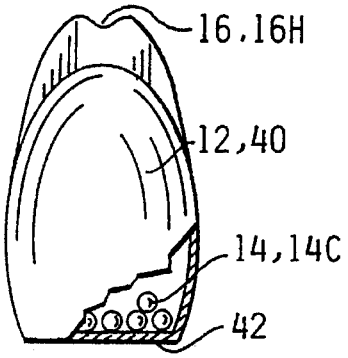
FIG. 6 is a partial cutaway and elevational side view of a container having an elliptical shape that includes a truncated end.

Another design configuration as shown in FIG. 5, employs a container 12 having a modified elliptical shape that has on one longitudinal side a substantially flat bottom section 40A. The elliptical shape 40 may have a truncated end 42 on one end as shown in FIG. 6. This truncated end 42 allows the container to be placed upright upon a flat surface as also shown in FIG. 6.

Figure 7:
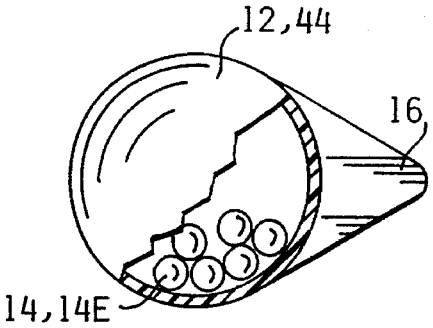
FIG. 7 is a partial cutaway and elevational side view of a container having a spherical shape.
Figure 8:
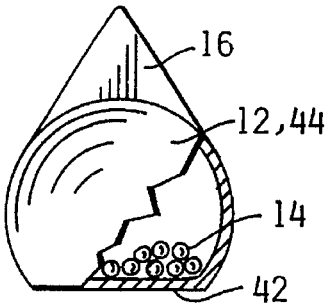
FIG. 8 is a partial cutaway and elevational side view of a container having a spherical shape that includes a truncated end.

In FIG. 7 is shown a container 12 having a spherical shape 44. This Shape can also include a truncated end 42 that allows the container to be placed in an upright position as shown in FIG. 8.

Figure 9:
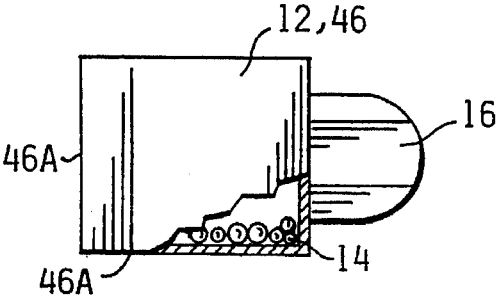
FIG. 9 is a partial cutaway and elevational side view of a container having cubic shape.

In FIG. 9 is shown a container having a rectangular or cubic shape 46. This cubic design has a plurality of flat surfaces 46A that allow the container 46 to be placed upon a flat surface.

Figure 10:
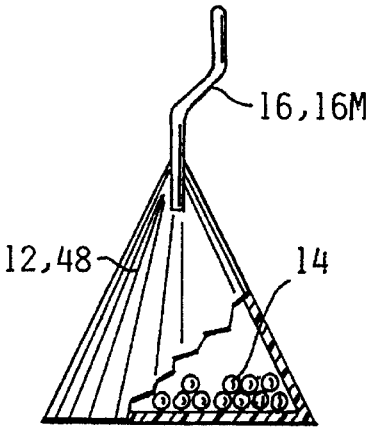
FIG. 10 is a partial cutaway and elevational side view of a container having a conic shape.

The final design configuration for the hollow enclosed container 12 utilizes a conic shape 48 as shown in FIG. 10. Since the bottom end of the conic shape is flat, it also can be placed in an upright position upon a flat surface.

The particles 14 shown throughout the figures, can consist of sand 14A, plastic beads 14B, wood beads 14C, steel pellets 14D, and/or lead pellets 14E. A typical container 12 having sand 14A is shown in FIG. 2. In FIG. 3, a combination of plastic beads 14B and steel pellets 14D are used. The use of wood beads 14C and lead pellets 14E are typically shown in FIGS. 6 and FIG. 7 respectively. Although specific pellets are shown in the above figures, any single or combination of particles 14 can be used in any of the designs. In the elongated cylindrically shaped design 18 that use a cap 24, the size and density provided by the various particles 14 are especially easily interchanged to suit the requirements of a particular musician.

Figure 4:
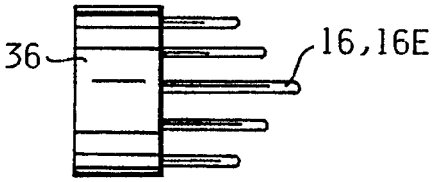
FIG. 4 is an elevational view of a threaded cap from where extends a strum rose pick.
Figure 11:
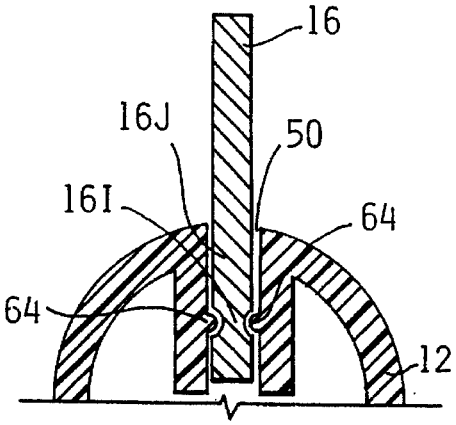
FIG. 11 is a sectional view showing a pick attachment means that uses a slot having a pair of male detents that accept a corresponding detent bore located on a pick.

The picks that are employed in the inventive device 10 are also varied. For example, as shown in FIG. 1, the basic design is shown with a dugain type pick 16A. A stainless steel pick 16B or copper pick 16C is shown in FIG. 2. In FIG. 3, is shown a first pick 16D having three blades that is attached to the first threaded cap 36. To the second threaded cap 38 as also shown in FIG. 3 is a second pick 16 having a picking section 16F that is located normal to the longitudinal axis of the container 18. In FIG. 4 is shown a strum rose pick 16E that allows a six-string guitar to simulate a twelve-string guitar. In FIG. 5 is shown a double pick that includes a first picking section 16G that is in alignment with the longitudinal axis of the container 4O and a second picking section 16F that is normal to the container's longitudinal axis. In FIG. 6, is shown a pick 16 having a centered indented section 16H that allows the pick 16 to be divided into two picking areas. Several other types of picks 16 can also be used in the inventive design, these other designs which are not shown but well known in the art, include a teckpick, stubby picks, and a speedpick 16M that is shown in FIG. 10. The speedpick 16M has a twisted lip angled at 10° to facilitate a more natural upright angle and to facilitate speed playing. Also depending on the type of music being played and the preference of the musician, the picks 16 can be selected with various thickness, gauges, shape and sizes. The shapes, which are also well known in the art, include small and large teardrops, triangle, rounded triangle and wedge shapes, The combination strumming pick and percussion device 10 is designed to allow the various picks to be attached by various pick attachment means; three pick attachment means are disclosed. In the preferred pick attachment means, the hollow enclosed container 12 is manufactured with a slot 50 that includes at least one aligned pair of male detents 64 that protrude from the sides of the slot as shown in FIG. 11. With this attachment means, a pick 16 is used that has a complimentary detent bore 16I on the pick's lower section 16J. When the pick is inserted into the slot 50, the detent bore 16I interfaces with the male detent 64 to securely hold the pick 16 in place.

Figure 12:
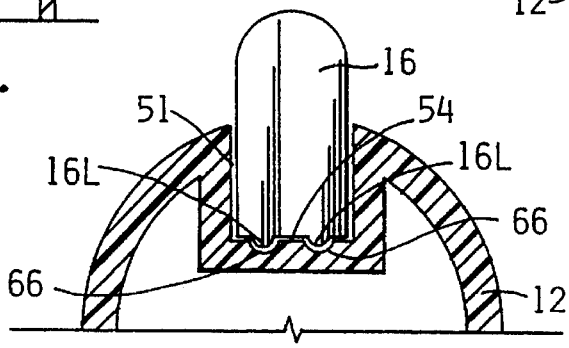
FIG. 12 is a sectional view showing a pick attachment means that employs a cavity having a pair of female detents that accept a corresponding pair of male detents located on the lower edge of a pick.

An alternative detent design is shown in FIG. 12 In this second attachment means, the container includes a cavity 51 having across its bottom surface 54 a pair of female detents 66. The pick 16 used with this attachment means includes on its lower edge of pair of male detents 16D. When the male detents are inserted into the female detents 66, the pick 16 is secured. With the attachment means that utilize detents, picks can be easily interchanged as desired by the musician.

Figure 13:
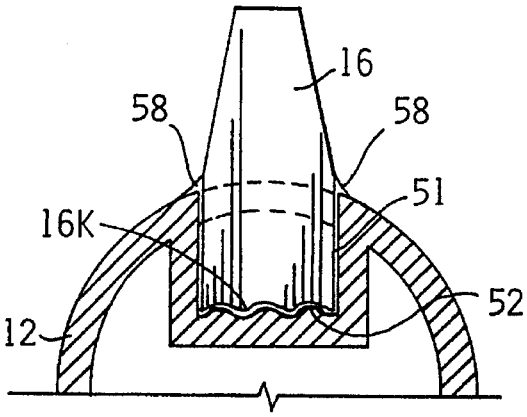
FIG. 13 is a sectional view showing a pick attachment means that employs a cavity having a serrated bottom section that interfaces with a pick having a corresponding serrated lower edge.

The third pick attachment means which is shown in FIG. 13 consist of manufacturing the enclosed container 12 with a cavity 51 that has a serrated bottom surface 52. With this attachment means, a pick 16 is used that has a corresponding serrated lower edge 16K as also shown in FIG. 13, that positionally maintains the pick when the two serrated surfaces interface. After placement of the pick, on adhesive 58 may be spread around the two outer interfacing surfaces to form reinforcing gussets that further secure the pick to the container.

Figure 14:
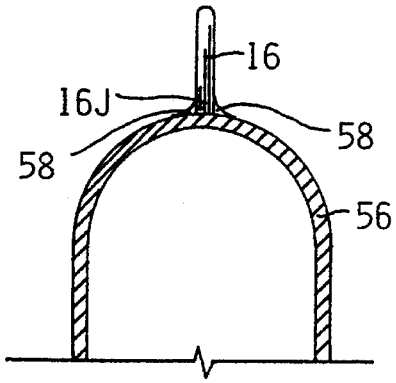
FIG. 14 is a sectional view showing a pick attachment means that uses a pick having a lower end with a shape that conforms to the shape of the container and that is held in place by an adhesive.

The fourth pick attachment means disclosed is shown in FIG. 14. This attachment means is accomplished by shaping the surface of the lower section 16J of the pick 16 to conform to the shape of the attachment section 56 of the container 12. Thereafter, the pick is attached by means of an adhesive 58 that forms reinforcing gussets around the interfacing surfaces.

Figure 15:
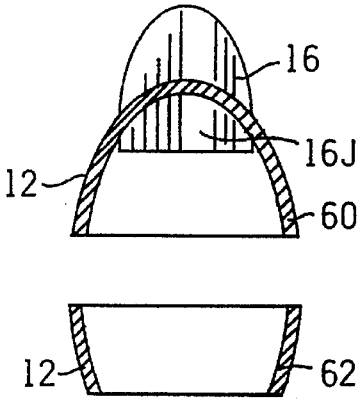
FIG. 15 is a sectional view showing a container made in two sections to facilitate manufacturing.

To facilitate the manufacturing of the device 10, the hollow enclosed container 12 is constructed in two halves, a first half 60 and a second half 62 as shown in FIG. 15. Although not shown, the two halves may also consist of longitudinal cuts. The direction of the cut used is dependent upon the design of the container 12.

Figure 17:
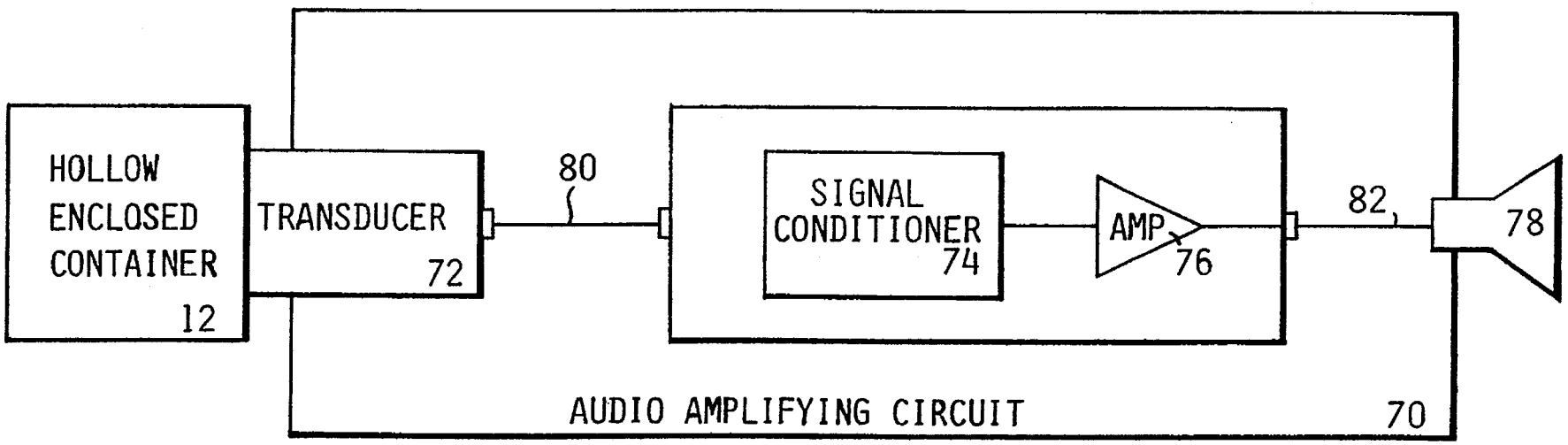
FIG. 17 is a block diagram of an audio amplifying circuit that allows the rhythmic sound produced by the deivde to be amplified and heard.

The final element of the invention disclosed is the audio amplifying circuit 70 as shown in FIG. 17. This circuit amplifies and reproduces the rhythmic sounds procured by the device 10. As also shown in FIG. 17, one implementation of the circuit 70 comprises a ceramic of piezoelectric transducer 72 that is attached to a surface of the hollow enclosed container 12. The transducer converts the mechanical energy produced by the guitar strings and particles to a proportional electrical signal. The signal from the transducer 72 is applied via a first cable assembly 80 to a signal conditioner 70 that constitutes an element of the audio amplifying circuit 70. From the signal conditioner 74, the signal is amplified by an amplifier 76. The output of the amplifier is an amplified audio signal that is applied via a second cable assembly 82 to an audio speaker 78 from where the rhythmic sound is heard.

Figure 16:
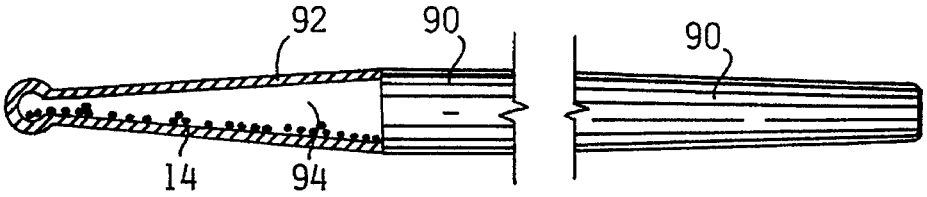
FIG. 16 is a partial cutaway and side view of a drumstick that utilizes the elements of the inventive device.

While the invention has been described in complete detail and pictorially shown in the accompanying drawings, it is not to be limited to such details since many changes and modifications may be made to the invention without departing from the spirit and scope thereof. For example, the utility of the invention is also applicable to other devices, one such device as shown in FIG. 16, is a drumstick 90. In this design, the forward section 92 of the drumstick 90 includes a cavity 94 into which is inserted a multiplicity of the particles 14. Hence, the invention is described to cover any and all modifications and forms which may come within the language and scope of the claims.

I claim:

1. A combination strumming pick and percussion device comprising:

a) a hollow enclosed container, b) a multiplicity of particles located within said container, and c) a pick having an upper section and a lower section, where the lower section is attached by an attachment means to said container, where when said container is oscillated to cause the upper section of said pick to strum strings of a stringed musical instrument, a rhythmic musical sound is emitted that includes the sound produced by the strummed musical instrument and a complimentary percussion sound produced by said particles impinging on the container.

2. The device as specified in claim 1 wherein said hollow enclosed container comprises an elongated cylinder.

3. The device as specified in claim 2 wherein said elongated cylinder further comprises:

a) an open end having a threaded section, b) a threaded cap sized to be threaded into the threaded section of said cylinder, and c) said pick attached to said cap by said attachment means.

4. The device as specified in claim 2 wherein said elongated cylinder further comprises:

a) an internal dividing baffle located substantially at a midpoint of said elongated cylinder, where said baffle divides the cylinder into a first cavity and a second cavity, b) said multiplicity of particles inserted into said cavities, where the particles inserted in the first cavity differ in size and density from the particles inserted into the second cavity, c) a first threaded end, d) a second threaded end, and e) a first threaded cap threaded into the first threaded end and a second threaded cap threaded into the second threaded end, said first cap having said pick embedded therein and said second cap having a second pick embedded therein.

5. The device as specified in claim 4 wherein the first threaded cap attached to the lower section of said pick having a plurality of pick blades and the second threaded cap attached to the second pick having a pick section that is located normal to a longitudinal axis of said container.

6. The device as specified in claim 5 wherein the plurality of pick blades attached to the first cap vary in length.

7. The device as specified in claim 1 wherein said hollow enclosed container has an elliptical shape.

8. The device as specified in claim 7 wherein one end of said elliptically shaped container is truncated to allow said container to be placed upright upon a flat surface and one longitudinal side of said container has a substantially flat bottom section.

9. The device as specified in claim 1 wherein said hollow enclosed container has a spherical shape.

10. The device as specified in claim 9 wherein one end of said spherically shaped container is truncated to allow said container to be placed upright upon a flat surface.

11. The device as specified in claim 1 wherein said hollow enclosed container has a cubic shape.

12. The device as specified in claim 1 wherein said hollow enclosed container has a conic shape.

13. The device as specified in claim 1 wherein said particles are made of plastic or wood beads.

14. The device as specified in claim 1 wherein said particles are made of steel or lead pellets.

15. The device as specified in claim 1 wherein said attachment means for attaching said pick to said hollow enclosed container comprises:

a) said container having a slot having at least one aligned pair of male detents that protrude from the sides of said slot, and b) said pick having a complimentary detent bore that is aligned with said male detents when said pick is inserted into said slot.

16. The device as specified in claim 1 wherein said means for attaching said pick to said hollow enclosed container comprises:

a) said container having a cavity with a serrated bottom surface, and b) said pick having a corresponding serrated lower edge that positionally maintains the pick when the serrated bottom surface and the corresponding serrated lower edge interface.

17. The device as specified in claim 1 wherein said means for attaching said pick to said hollow enclosed container comprises:

a) said container having a cavity with a bottom surface having a pair of female detents, and b) said pick having a lower edge having a pair of male detents that interface with the female detents on said cavity.

18. The device as specified in claim 1 wherein said attachment means for attaching the lower section of said pick to said hollow enclosed container is comprised of the lower section of said pick being conformed to the shape of said container and said pick attached to said container by means of an adhesive.

19. The device as specified in claim 1 wherein said hollow enclosed container is comprised of two halves to facilitate manufacturing.

20. The device as specified in claim 1 further comprising an audio amplifying circuit that amplifies and reproduces the rhythmic musical sound produced by said device.

21. The device as specified in claim 19 wherein said audio amplifying circuit further comprises:

a) a transducer attached to a surface of said hollow enclosed container, b) a signal processing and amplifying circuit having a signal conditioner that receives a signal from said transducer via a first cable assembly, and c) an audio amplifier that receives the conditioned signal from said signal conditioner and subsequently generates an amplified audio signal that is applied via a second cable assembly to an audio speaker.

* * * * *